US008247719B2

(12) United States Patent
Lee et al.

(10) Patent No.: US 8,247,719 B2
(45) Date of Patent: Aug. 21, 2012

(54) BUTTON DEVICE

(75) Inventors: Guang-Yao Lee, Tu-Cheng (TW); Hsuan-Tsung Chen, Tu-Cheng (TW); Gang Liu, Shenzhen (CN); Qing-Hui Mi, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 208 days.

(21) Appl. No.: 12/878,000

(22) Filed: Sep. 8, 2010

(65) Prior Publication Data

US 2011/0253517 A1 Oct. 20, 2011

(51) Int. Cl.
*H01H 13/83* (2006.01)

(52) U.S. Cl. ..... 200/296; 200/310; 200/313; 200/314; 200/341; 200/343

(58) Field of Classification Search ..... 200/520, 200/533, 534, 573, 574, 293, 296, 310, 313, 200/314, 329–331, 341–345
See application file for complete search history.

(56) References Cited

U.S. PATENT DOCUMENTS

| | | | | |
|---|---|---|---|---|
| 6,365,855 | B1 * | 4/2002 | Sutter et al. | 200/314 |
| 7,173,205 | B2 * | 2/2007 | Yamamoto | 200/343 |
| 7,635,820 | B2 * | 12/2009 | Shen et al. | 200/314 |
| 2003/0094357 | A1 * | 5/2003 | Lin | 200/341 |
| 2006/0016680 | A1 * | 1/2006 | Watanabe | 200/517 |
| 2006/0113175 | A1 * | 6/2006 | Uchizono et al. | 200/341 |
| 2007/0187218 | A1 * | 8/2007 | Chen et al. | 200/296 |
| 2009/0159411 | A1 * | 6/2009 | Guo et al. | 200/296 |
| 2010/0254102 | A1 * | 10/2010 | Furubo | 361/752 |

* cited by examiner

*Primary Examiner* — Michael Friedhofer
(74) *Attorney, Agent, or Firm* — Altis Law Group, Inc.

(57) ABSTRACT

A button device includes a button unit, a resilient member, and a switch unit. The button unit includes a button, a transparent power icon member, and a retaining member. The power iron member is attached to the button. The retaining member includes an elastic element, a tray located at one end of the elastic element, and a fixing loop located at the other end of the elastic element. The button and the power iron member are retained on the tray. The tray includes a seat with a hole for receiving an illuminator, and reflects lights of the illuminator to the power icon member. The resilient member is sandwiched between the button unit and the switch unit to reset the button unit back to its original position.

12 Claims, 3 Drawing Sheets

BUTTON DEVICE

BACKGROUND

1. Technical Field

The present disclosure relates to a button device, and more particularly to a power button device.

2. Description of Related Art

Electronic devices (such as computers) are becoming widely used. A power button device is often provided to activate power on/off functions of the computer. The button device conventionally includes a button, a cover with a power icon, and a switch secured in a holder and attached to the cover. The button includes a pressing portion, when pressed, enables a contact portion thereof to engage the switch, thereby connecting/disconnecting a circuit and activating the power on/off functions. The power icon is illuminated by a LED (light-emitting diode) mounted on a main board of the computer by light pipes. However, lights of the LED may be weakened after transmitted by light pipes and the power icon may not be clearly seen.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
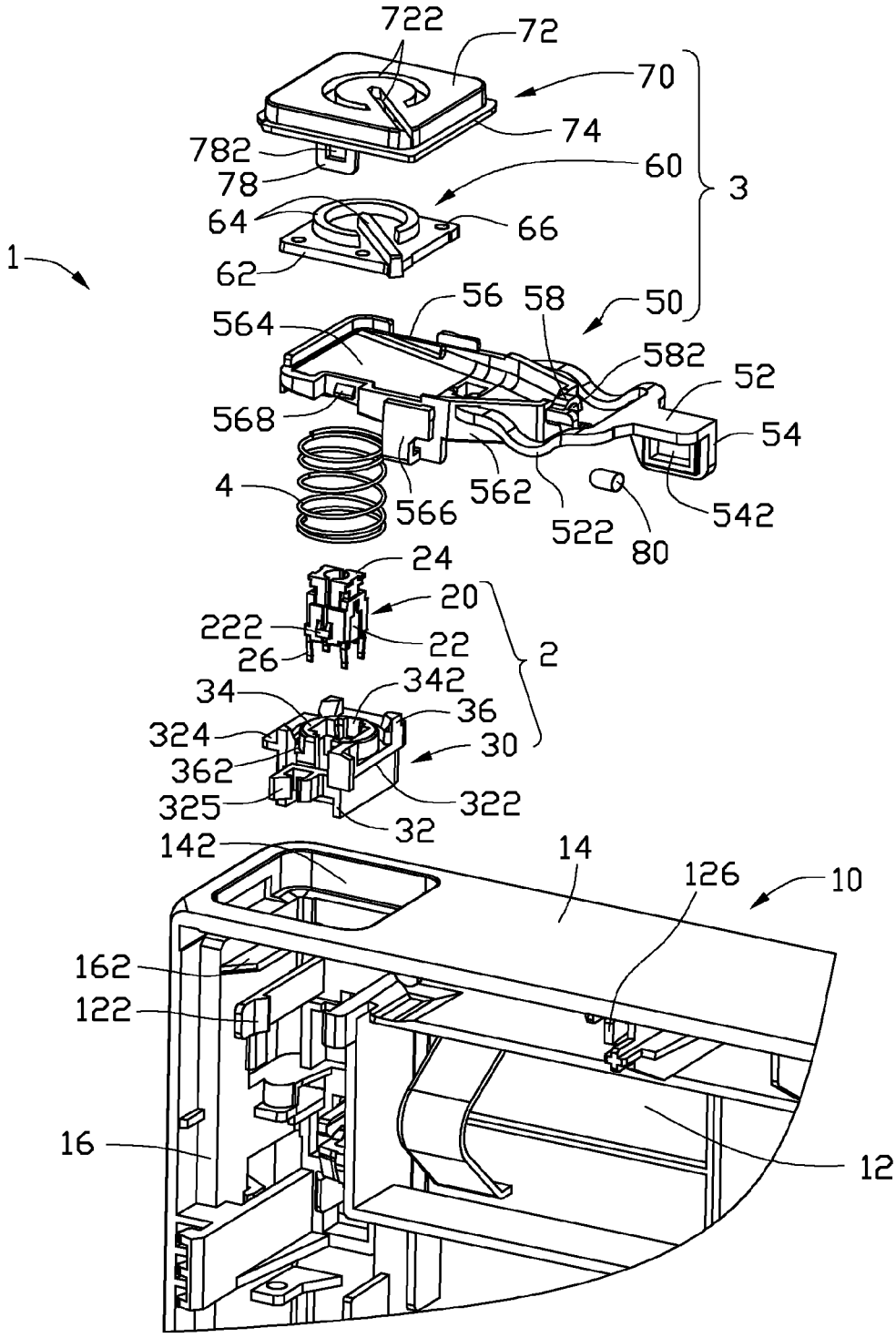
FIG. 1 is an exploded, isometric view of an exemplary embodiment of a button device.
Figure 2:
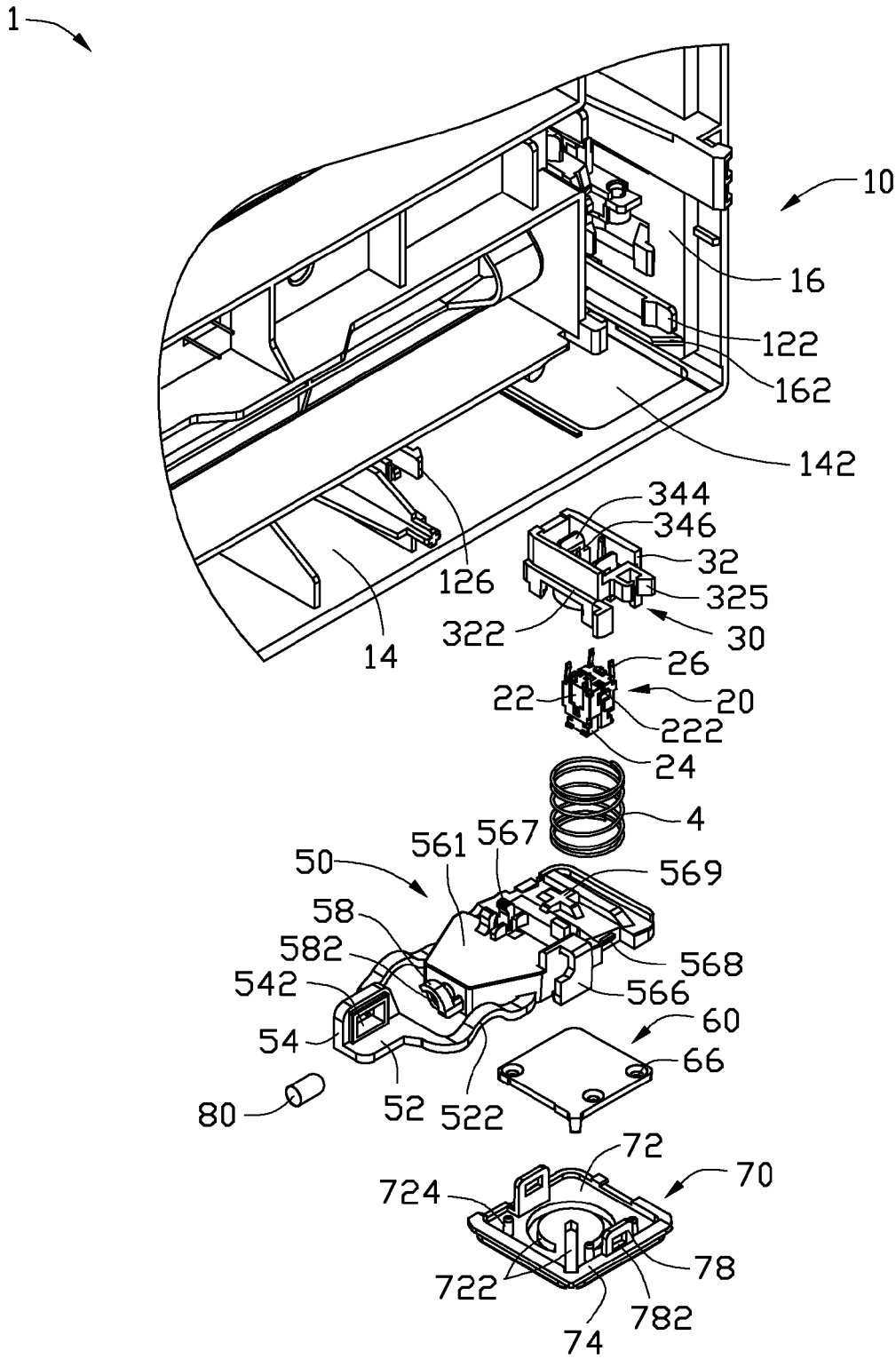
FIG. 2 is similar to FIG. 1, but viewed from another perspective.

Referring to FIGS. 1 and 2, an exemplary embodiment of a button device 1 is used in an electronic device such as a computer for activating power on/off functions. The button device 1 includes a switch unit 2, a button unit 3, and a resilient member 4 located between the switch unit 2 and the button unit 3. The switch unit 2 and the button unit 3 are correspondingly attached to a chassis 10 of the computer. The button unit 3 is movable to activate the switch unit 2. The button unit 3 includes a button 70, a transparent power icon member 60, and a retaining member 50. The switch unit 2 includes a switch 20, a holder 30 for holding the switch 20 therein. In the embodiment, the resilient member 4 is a coil spring.

The chassis 10 includes a first panel 14, a second panel 12, and a third panel 16. The first panel 14 is generally rectangular. The second panel 12 and the third panel 16 perpendicularly extend from two adjacent edges of the first panel 14. An opening 142 is defined in the first panel 14. The second panel 12 includes a pair of hooks 122 extending toward each other, and a fixing bar 126 extending perpendicularly from an inside thereof. The third panel 16 includes a limiting board 162 extending from an inside thereof, located above the hooks 122.

The holder 30 includes a rectangular frame 32, a cylindrical body 34 formed at one end of the frame 32, and a plurality of guiding blocks 36 surrounding the cylindrical body 34. An annular groove 362 is defined between the cylindrical body 34 and the guiding blocks 36. A receiving hole 342 is defined in the cylindrical body 34 and extends through the frame 32. A pair of flexible mounting tabs 344 each with a mounting hole 346 extends from inside walls of the receiving hole 342. A first position flange 322 and a second position flange 324 respectively extend from outsides of two opposite sidewalls of the frame 32, one located higher than another. A wire clamp 325 extends from one end wall of the frame 32.

The switch 20 includes a pair of catches 222 formed at two opposite sidewalls 22 thereof, a trigging wall 24 formed at one end thereof, and a plurality of terminals 26 formed at another end thereof.

The retaining member 50 includes an elastic element 52, a tray 56, and a fixing loop 54. The tray 56 includes a receiving space 564 bounding by a base wall 561 and a pair of symmetrical curved sidewalls 562. Inside sections of the base wall 561 and sidewalls 562 may be coated with light reflecting material. The elastic element 52 has a fork-shaped configuration and includes a pair of curved arms 522 respectively connecting with the sidewalls 562 of the tray 56. A pair of hooks 568 respectively extends from the sidewalls 562 of the tray 56. Two wire clamps 566 and 567 respectively extend from one of the sidewalls 562 and a bottom of the base wall 561 of the tray 56. The fixing loop 54 with a fixing hole 542 perpendicularly extends down from an end of the elastic member 52 distal from the tray 56. An illuminator seat 58 with a hole 582 is formed at an end portion of the tray 56 facing the fixing loop 54, to retaining an illuminator 80 therein, such as an LED. The wire clamps 325, 566 and 567 are for managing wires connecting with the illuminator 80. A crossed resisting block 569 extrudes from the bottom of the base wall 561 of the tray 56.

The power icon member 60 includes a rectangular plate 62, a power icon 64 extruding from the plate 62, and a plurality of through holes 66 defined beside the power icon 64.

The button 70 has a cap configuration and includes a rectangular raised platform 72, and a flange 74 perpendicularly extending from edges of the raised platform 72. A pair of locking tabs 78 on opposing sides from each other, each with a locking hole 782 which protrudes out from the flange 74. A receiving slot 722 is defined in the raised platform 72, corresponding to and allowing within, the power icon 64 of the power icon member 60. A plurality of posts 724 protrudes out from an inside of the raised platform 72.

In assembly of the button unit 3, the power icon member 60 is attached to the button 70, with the power icon 64 received in the receiving slot 722 and the posts 724 interferentially engaging in the through holes 66. The combined button 70 and power icon member 60 cover the receiving space 564 of the retaining member 50, and the hooks 568 engaging in the locking holes 782 of the locking tabs 78 of the button 70. The flange 74 of the button 70 contacts tops of the sidewalls 562 of the tray 56. The illuminator 80 is inserted in the hole 582 of the illuminator seat 58 of the retaining member 50.

In assembly of the switch unit 2, the switch 20 is inserted into the receiving hole 342 of the cylindrical body 34 of the holder 30, with the catches 222 engaging in the mounting holes 346 of the mounting tabs 344.

Figure 3:
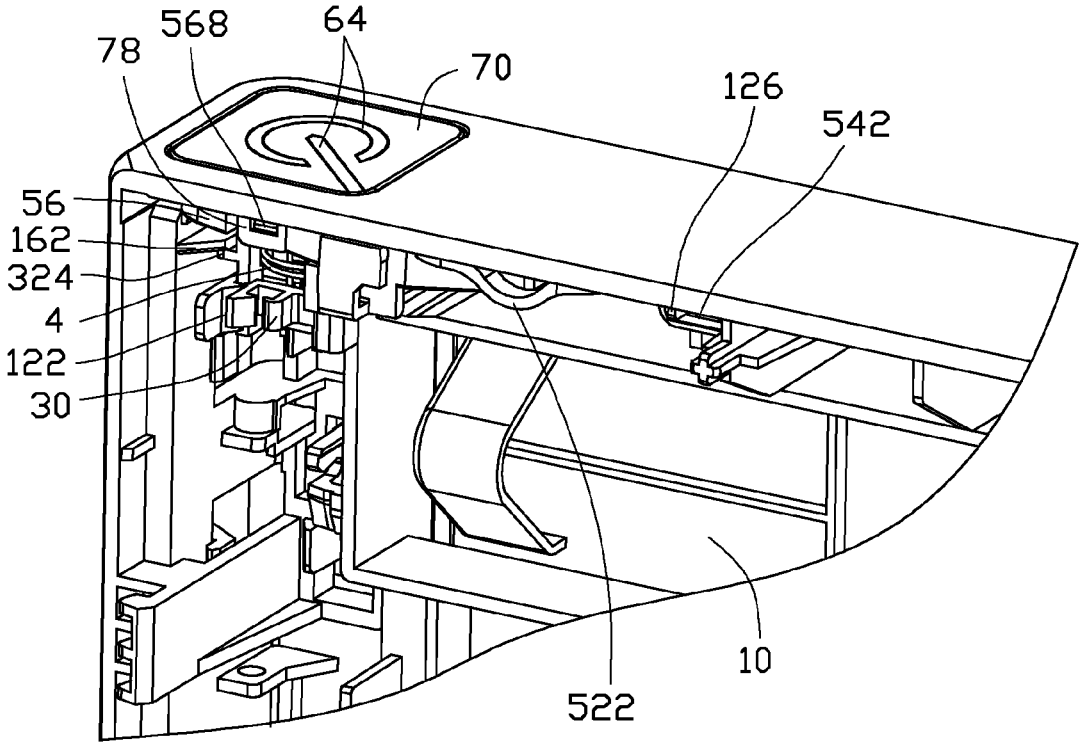
FIG. 3 is an assembled, isometric view of the button device of FIG. 1.

Referring also to FIG. 3, in assembly of the button device 1, the button unit 3 is attached to the chassis 10, with the raised platform 72 of the button 70 extending in the opening 142 of the first panel 14 and the fixing bar 126 engaging in the fixing hole 542 of the fixing loop 54 of the retaining member 50. Then, the switch unit 2 is attached to the chassis 10, with one end of the resilient member 4 fixing around the resisting block 569 of the tray 56 and abutting the bottom of base wall 561 of the tray 56, and the other end of the resilient member 4 received in the annular groove 362 of the holder 30. The trigging wall 24 of the switch 20 is in alignment with the resisting block 569 of the retaining member 50. The frame 32 of the holder 30 is sandwiched between the hooks 122 of the chassis 10. The second position flange 324 and the first position flange 322 of the holder 30 respectively abut a lower side of the limiting board 162 and an upper side of the hook 122 distal from the limiting board 162. The terminals 26 of the switch 20 are electrically connected with a power and the illuminator 80.

In use, when the raised platform 72 of the button 70 is pressed, the plate 62 of the power icon member 60 abuts against the base wall 561 of the tray 56 of the retaining member 50 to move down and the arms 522 of the elastic element 52 are stretched and the resilient member 4 is compressed. The resisting block 569 of the retaining member 50 is moved accordingly abutting against the trigging wall 24 of the switch 20 to activate a power-on function of the computer. At the same time, the illuminator 80 attached to the tray 56 is illuminated and the tray 56 reflects the light of the illuminator 80 to the power icon 64 of the button unit 3. Thus, the power icon 64 can be clearly seen. When the button 70 is released, the arms 522 and the resilient member 4 rebound to reset the button unit 2 back to its original position. A power-off function of the computer may be similarly activated.

It is to be understood, however, that even though numerous characteristics and advantages of the embodiments have been set forth in the foregoing description, together with details of the structure and function of the embodiments, the present disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A button device attached to a chassis of an electronic device for activating power on/off functions of the electronic device, the button device comprising:

a button unit comprising a button, a transparent power icon member attached to the button, and a retaining member; the retaining member comprising a tray on which the button and the power icon member are retained, a fixing loop attached to the chassis, and an elastic element arranged between the tray and the fixing loop; a seat with a hole for receiving an illuminator formed at the tray which reflects lights of the illuminator to the power icon member; and a switch unit attached to the chassis and driven by the tray of the button unit to activate power on/off functions; and a resilient member arranged between the button unit and the switch unit to reset the button unit back to its original position.

2. The button device of claim 1, wherein the power iron member comprises a plate, and a power icon protruding from the plate; the button comprises a raised platform, and a flange surrounding the platform; a receiving slot is defined in the platform to receive the power icon therein.

3. The button device of claim 2, wherein the plate of the power iron member comprises a plurality of through holes defined therein beside the power iron; the platform of the button comprises a plurality of posts interferentially engaging in the through holes.

4. The button device of claim 2, wherein the tray comprises a receiving space bounding by a base wall and a pair of sidewalls thereof, and the button and the power iron member cover the receiving space.

5. The button device of claim 4, wherein a pair of opposite locking tabs each with a locking hole extends from the flange of the button, and a pair of hooks extends from the sidewalls of the tray to engage in the locking holes of the button.

6. The button device of claim 4, wherein insides of the base wall and sidewalls are coated with light reflecting material.

7. The button device of claim 4, wherein a plurality of wire clamps extends from the base wall and the sidewalls of the tray to manage wires connecting with the illuminator.

8. The button device of claim 4, wherein the elastic element has a fork-shaped configuration and comprises a pair of curved arms; distal ends of the arms are connected to the sidewalls of the tray, the fixing loop is formed at the elastic element distal from the tray.

9. The button device of claim 4, wherein the switch unit comprises a switch, and a holder attached to the chassis.

10. The button device of claim 9, wherein the holder comprises a frame, a cylindrical body formed at one end of the frame; a receiving hole is defined in the cylindrical body and extends through the frame to receive the switch, a pair of flexible mounting tabs each with a mounting hole extends from inside walls of the receiving hole, a pair of catches is formed at the switch to engage in the mounting holes.

11. The button device of claim 10, wherein the resilient member is a coil spring, a plurality of guiding blocks extends from the frame and surrounds the cylindrical body, an annular groove is defined between the guiding blocks and the cylindrical body, a bottom of the base wall of the tray comprises a resisting block; one end of the coil spring surrounds the resisting block and abuts the bottom of the base wall of the tray, and the other end of the coil spring is received in the annular groove.

12. The button device of claim 10, wherein a pair of positioning flanges is formed at outsides of the frame to position the frame in the chassis, one located higher than another.

* * * * *